US006398500B2

(12) United States Patent
Pedersen et al.

(10) Patent No.: US 6,398,500 B2
(45) Date of Patent: Jun. 4, 2002

(54) RETENTION SYSTEM AND METHOD FOR THE BLADES OF A ROTARY MACHINE

(75) Inventors: Poul D. Pedersen, Cincinnati; Christopher C. Glynn, Hamilton, both of OH (US); Roger C. Walker, Piedmont, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/863,899

(22) Filed: May 24, 2001

Related U.S. Application Data

(63) Continuation of application No. 09/466,900, filed on Dec. 20, 1999, now abandoned.

(51) Int. Cl.[7] ..... F01D 5/32
(52) U.S. Cl. ..... 416/220 R; 416/221; 29/889.21
(58) Field of Search ..... 416/219 R, 220 R, 416/221, 248; 29/889.21

(56) References Cited

U.S. PATENT DOCUMENTS

| | | | | |
|---|---|---|---|---|
| 4,108,571 | A | 8/1978 | Mawson | |
| 4,208,170 | A | 6/1980 | Tucker et al. | |
| 4,890,981 | A | 1/1990 | Corsmeier et al. | |
| 4,915,587 | A | 4/1990 | Pisz et al. | |
| 5,256,035 | A | 10/1993 | Norris et al. | |
| 5,259,728 | A | 11/1993 | Szpunar et al. | |
| 5,282,720 | A | 2/1994 | Szunar | |
| 5,302,086 | A | 4/1994 | Kulesa et al. | |
| 5,445,499 | A | 8/1995 | Charbonnel | |
| 5,713,721 | A | 2/1998 | Glynn et al. | |
| 5,860,787 | A | 1/1999 | Richards | |
| 6,234,756 | B1 * | 5/2001 | Ress, Jr. et al. | 416/220 R |

FOREIGN PATENT DOCUMENTS

JP 58-35203 3/1983

OTHER PUBLICATIONS

"39$^{th}$ GE Turbine State–of–the–Art Technology Seminar", Tab 1, ""F" Technology—the First Half–Million Operating Hours", H.E. Miller, Aug. 1996.
"39th GE Turbine State–of–the–Art Technology Seminar", Tab 2, "GE Heavy–Duty Gas Turbine Performance Characteristics", F. J. Brooks, Aug. 1996.
"39th GE Turbine State–of–the–Art Technology Seminar", Tab 3, "9EC 50Hz 170–MW Class Gas Turbine", A. S. Arrao, Aug. 1996.
"39th GE Turbine State–of–the–Art Technology Seminar", Tab 4, "MWS6001FA—An Advanced–Technology 70–MW Class 50/60 Hz Gas Turbine", Ramachandran et al., Aug. 1996.

(List continued on next page.)

*Primary Examiner*—Christopher Verdier
(74) *Attorney, Agent, or Firm*—Nixon & Vanderhye P.C.

(57) ABSTRACT

A retention system and method for the blades of a rotary machine for preventing forward or aft axial movement of the rotor blades includes a circumferential hub slot formed about a circumference of the machine hub. The rotor blades have machined therein a blade retention slot which is aligned with the circumferential hub slot when the blades are received in correspondingly shaped openings in the hub. At least one ring segment is secured in the blade retention slots and the circumferential hub slot to retain the blades from axial movement. A key assembly is used to secure the ring segments in the aligned slots via a hook portion receiving the ring segments and a threaded portion that is driven radially outwardly by a nut. A cap may be provided to provide a redundant back-up load path for the centrifugal loads on the key. Alternatively, the key assembly may be formed in the blade dovetail.

17 Claims, 4 Drawing Sheets

OTHER PUBLICATIONS

"39th GE Turbine State–of–the–Art Technology Seminar", Tab 5, "Turbomachinery Technology Advances at Nuovo Pignone", Benvenuti et al., Aug. 1996.
"39th GE Turbine State–of–the–Art Technology Seminar", Tab 6, "GE Aeroderivative Gas Turbines—Design and Operating Features", M.W. Horner, Aug. 1996.
"39th GE Turbine State–of–the–Art Technology Seminar", Tab 7, "Advance Gas Turbine Materials and Coatings", P.W. Schilke, Aug. 1996.
"39th GE Turbine State–of–the Art Technology Seminar", Tab 8, "Dry Low $NO_x$ Combustion Systems for GE Heavy–Duty Turbines", L. B. Davis, Aug. 1996.
"39th GE Turbine State–of–the–Art Technology Seminar", Tab 9, "GE Gas Turbine Combustion Flexibility", M. A. Davi, Aug. 1996.
"39th GE Turbine State–of–the–Art Technology Seminar", Tab 10, "Gas Fuel Clean–Up System Design Considerations for GE Heavy–Duty Gas Turbines", C. Wilkes, Aug. 1996.
"39th GE Turbine State–of–the–Art Technology Seminar", Tab 11, "Integrated Control Systems for Advanced Combined Cycles", Chu et al., Aug. 1996.
"39th GE Turbine State–of–the–Art Technology Seminar", Tab 12, "Power Systems for the 21st Century "H" Gas Turbine Combined Cycles", Paul et al., Aug. 1996.
"39th GE Turbine State–of–the–Art Technology Seminar", Tab 13, "Clean Coal and Heavy Oil Technologies for Gas Turbines", D. M. Todd, Aug. 1996.
"39th GE Turbine State–of–the–Art Technology Seminar", Tab 14, "Gas Turbine Conversions, Modifications and Uprates Technology", Stuck et al., Aug. 1996.
"39th GE Turbine State–of–the–Art Technology Seminar", Tab 15, "Performance and Reliability Improvements for Heavy–Duty Gas Turbines", J. R. Johnston, Aug. 1996.
"39th GE Turbine State–of–the–Art Technology Seminar", Tab 16, "Gas Turbine Repair Technology", Crimi et al, Aug. 1996.
"39th GE Turbine State–of–the–Art Technology Seminar", Tab 17, "Heavy Duty Turbine Operating & Maintenance Considerations", R. F. Hoeft, Aug. 1996.
"39th GE Turbine State–of–the–Art Technology Seminar", Tab 18, "Gas Turbine Performance Monitoring and Testing", Schmitt et al., Aug. 1996.
"39th GE Turbine State–of–the–Art Technology Seminar", Tab 19, "Monitoring Service Delivery System and Diagnostics", Madej et al., Aug. 1996.
"39th GE Turbine State–of–the–Art Technology Seminar", Tab 20, "Steam Turbines for Large Power Applications", Reinker et al., Aug. 1996.
"39th GE Turbine State–of–the–Art Technology Seminar", Tab 21, "Steam Turbines for Ultrasupercritical Power Plants", Retzlaff et al., Aug. 1996.
"39th GE Turbine State–of–the–Art Technology Seminar", Tab 22, "Steam Turbine Sustained Efficiency", P. Schofield, Aug. 1996.
"39th GE Turbine State–of–the–Art Technology Seminar", Tab 23, "Recent Advances in Steam Turbines for Industrial and Cogeneration Applications", Leger et al., Aug. 1996.
"39th GE Turbine State–of–the–Art Technology Seminar", Tab 24, "Mechanical Drive Steam Turbines", D. R. Leger, Aug. 1996.
"39th GE Turbine State–of–the–Art Technology Seminar", Tab 25, "Steam Turbines for STAG™ Combined–Cycle Power Systems", M. Boss, Aug. 1996.
"39th GE Turbine State–of–the–Art Technology Seminar", Tab 26, "Cogeneration Application Considerations", Fisk et al., Aug. 1996.
"39th GE Turbine State–of–the–Art Technology Seminar", Tab 27, "Performance and Economic Considerations of Repowering Steam Power Plants", Stoll et al., Aug. 1996.
"39th GE Turbine State–of–the–Art Technology Seminar", Tab 28, "High–Power Density™ Steam Turbine Design Evolution", J. H. Moore, Aug. 1996.
"39th GE Turbine State–of–the–Art Technology Seminar", Tab 29, "Advances in Steam Path Technologies", Cofer, IV, et al., Aug. 1996.
"39th GE Turbine State–of–the–Art Technology Seminar", Tab 30 , "Upgradable Opportunities for Steam Turbines", D. R. Dreier, Jr., Aug. 1996.
"39th GE Turbine State–of–the–Art Technology Seminar", Tab 31, "Uprate Options for Industrial Turbines", R. C. Beck, Aug. 1996.
"39th GE Turbine State–of–the–Art Technology Seminar", Tab 32, "Thermal Performance Evaluation and Assessment of Steam Turbine Units", P. Albert, Aug. 1996.
"39th GE Turbine State–of–the–Art Technology Seminar", Tab 33, "Advances in Welding Repair Technology" J. F. Nolan, Aug. 1996.
"39th GE Turbine State–of–the–Art Technology Seminar", Tab 34, "Operation and Maintenance Strategies to Enhance Plant Profitability", MacGillivray et al., Aug. 1996.
"39th GE Turbine State–of–the–Art Technology Seminar", Tab 35, "Generator Insitu Inspections", D. Stanton.
"39th GE Turbine State–of–the–Art Technology Seminar", Tab 36, "Generator Upgrade and Rewind", Halpern et al., Aug. 1996.
"39th GE Turbine State–of–the–Art Technology Seminar", Tab 37, "GE Combined Cycle Produce Line and Performance", Chase, et al., Aug. 1996.
"39th GE Turbine State–of–the–Art Technology Seminar", Tab 38, "GE Combined Cycle Experience", Maslak et al., Aug. 1996.
"39th GE Turbine State–of–the–Art Technology Seminar", Tab 39, "Single–Shaft Combined Cycle Power Generation Systems", Tomlinson et al., Aug. 1996.
"Advanced Turbine System Program—Conceptual Design and Product Development", Annual Report, Sep. 1, 1994—Aug. 31, 1995.
"Advanced Turbine Systems (ATS Program) Conceptual Design and Product Development", Final Technical Progress Report, vol. 2– Industrial Machine, Mar. 31, 1997, Morgantown, WV.
"Advanced Turbine Systems (ATS Program), Conceptual Design and Product Development", Final Technical Progress Report, Aug. 31, 1996, Morgantown, WV.
"Advanced Turbine Systems (ATS) Program, Phase 2, Conceptual Design and Product Development", Yearly Technical Progress Report, Reporting Period: Aug. 25, 1993—Aug. 31, 1994.
"Advanced Turbine Systems" Annual Program Review, Preprints, Nov. 2–4, 1998, Washington, D.C. U.S. Department of Energy, Office of Industrial Technologies Federal Energy Technology Center.
"ATS Conference" Oct. 28, 1999, Slide Presentation.
"Baglan Bay Launch Site", various articles relating to Baglan Energy Park.
"Baglan Energy Park", Brochure.

"Commercialization", Del Williamson, Present, Global Sales, May 8, 1998.
"Environmental, Health and Safety Assessment: ATS 7H Program (Phase 3R) Test Activities at the GE Power Systems Gas Turbine Manufacturing Facility, Greenville, SC", Document #1753, Feb. 1998, Publication Date: Nov. 17, 1998, Report Nos. DE–FC21–95MC31176—11.
"Exhibit panels used at 1995 product introduction at PowerGen Europe".
"Extensive Testing Program Validates High Efficiency, reliability of GE's Advanced "H" Gas Turbine Technology", Press Information, Press Release, 96–NR14, Jun. 26, 1996, H Technology Tests/pp. 1–4.
"Extensive Testing Program Validates High Efficiency, Reliability of GE's Advanced "H" Gas Turbine Technology", GE Introduces Advanced Gas Turbine Technology Platform: First to Reach 60% Combined–Cycle Power Plant Efficiency, Press Information, Press Release, Power–Gen Europe '95, 95–NRR15, Advanced Technology Introduction/pp. 1–6.
"Gas, Steam Turbine Work as Single Unit in GE's Advanced H Technology Combined–Cycle System", Press Information, Press Release, 95–NR18, May 16, 1995, Advanced Technology Introduction/pp. 1–3.
"GE Breaks 60% Net Efficiency Barrier" paper, 4 pages.
"GE Businesses Share Technologies and Experts to Develop State–Of–The–Art Products", Press Information, Press Release 95–NR10, May 16, 1995, GE Technology Transfer/pp. 1–3.
"General Electric ATS Program Technical Review, Phase 2 Activities", T. Chance et al., pp. 1–4.
"General Electric's DOE/ATS H Gas Turbine Development" Advanced Turbine Systems Annual Review Meeting, Nov. 7–8, 1996, Washington, D.C., Publication Release.
"H Technology Commercialization", 1998 MarComm Activity Recommendation, Mar., 1998.
"H Technology", Jon Ebacher, VP, Power Gen Technology, May 8, 1998.
"H Testing Process", Jon Ebacher, VP, Power Gen Technology, May 8, 1998.
"Heavy–Duty & Aeroderivative Products" Gas Turbines, Brochure, 1998.
"MS7001H/MS9001H Gas Turbine, gepower.com website for PowerGen Europe" Jun. 1–3 going public Jun. 15, (1995).
"New Steam Cooling System is a Key to 60% Efficiency For GE "H" Technology Combined–Cycle Systems", Press Information, Press Release, 95–NRR16, May 16, 1995, H Technology/pp. 1–3.
"Overview of GE's H Gas Turbine Combined Cycle", Jul. 1, 1995 to Dec. 31, 1997.
"Power Systems for the 21st Century—"H" Gas Turbine Combined Cycles", Thomas C. Paul et al., Report.
"Power–Gen '96 Europe", Conference Programme, Budapest, Hungary, Jun. 26–28, 1996.
"Power–Gen International", 1998 Show Guide, Dec. 9–11, 1998, Orange County Convention Center, Orlando, Florida.
"Press Coverage following 1995 product announcement"; various newspaper clippings relating to improved generator.
"Proceedings of the Advanced Turbine Systems Annual Program Review Meeting", vol. I, "Industrial Advanced Turbine Systems Program Overview", D.W. Esbeck, p. 3–13, Oct., 1995.
"Proceedings of the Advanced Turbine Systems Annual Program Review Meeting", vol. I, "H Gas Turbine Combined Cycle", J. Corman, p. 14–21, Oct., 1995.
"Proceedings of the Advanced Turbine Systems Annual Program Review Meeting", vol. I, "Overview of Westinghouse's Advanced Turbine Systems Program", Bannister et al., p. 22–30, Oct., 1995.
"Proceedings of the Advanced Turbine Systems Annual Program Review Meeting", vol. I, "Allison Engine ATS Program Technical Review", D. Mukavetz, p. 31–42, Oct., 1995.
"Proceedings of the Advanced Turbine Systems Annual Program Review Meeting", vol. I, "Advanced Turbine Systems Program Industrial System Concept Development", S. Gates, p. 43–63, Oct., 1995.
"Proceedings of the Advanced Turbine Systems Annual Program Review Meeting", vol. I, "Advanced Turbine System Program Phase 2 Cycle Selection", Latcovich, Jr., p. 64–69, Oct., 1995.
"Proceedings of the Advanced Turbine Systems Annual Program Review Meeting", vol. I, "General Electric ATS Program Technical Review Phase 2 Activities", Chance et al., p. 70–74, Oct., 1995.
"Proceedings of the Advanced Turbine Systems Annual Program Review Meeting", vol. I, "Technical Review of Westinghouse's Advanced Turbine Systems Program", Diakunchak et al., p. 75–86, Oct., 1995.
"Proceedings of the Advanced Turbine Systems Annual Program Review Meeting", vol. I, "Advanced Combustion Turbines and Cycles: An EPRI Perspective", Touchton et al., p. 87–88, Oct., 1995.
"Proceedings of the Advanced Turbine Systems Annual Program Review Meeting", vol. I, "Advanced Turbine Systems Annual Program Review", William E. Koop, p. 89–92, Oct., 1995.
"Proceedings of the Advanced Turbine Systems Annual Program Review Meeting", vol. I, "The AGTSR Consortium: An Update", Fant et al., p. 93–102, Oct., 1995.
"Proceedings of the Advanced Turbine Systems Annual Program Review Meeting", vol. I, "Overview of Allison/AGTSR Interactions", Sy A. Ali, p. 103–106, Oct., 1995.
"Proceedings of the Advanced Turbine Systems Annual Program Review Meeting", vol. I, "Design Factors for Stable Lean Premix Combustion", Richards et al., p. 107–113, Oct., 1995.
"Proceedings of the Advanced Turbine Systems Annual Program Review Meeting", vol. I, "Ceramic Stationary as Turbine", M. van Roode, p. 114–147, Oct., 1995.
"Proceedings of the Advanced Turbine Systems Annual Program Review Meeting", vol. I, "DOE/Allison Ceramic Vane Effort", Wenglarz et al., p. 148–151, Oct., 1995.
"Proceedings of the Advanced Turbine Systems Annual Program Review Meeting", vol. I, "Materials/Manufacturing Element of the Advanced Turbine Systems Program", Karnitz et al., p. 152–160, Oct., 1995.
"Proceedings of the Advanced Turbine Systems Annual Program Review Meeting", vol. I, "Land–Based Turbine Casting Initiative", Mueller et al., p. 161–170, Oct., 1995.
"Proceedings of the Advanced Turbine Systems Annual Program Review Meeting", vol. I, "Turbine Airfoil Manufacturing Technology", Kortovich, p. 171–181, Oct., 1995.

"Proceedings of the Advanced Turbine Systems Annual Program Review Meeting", vol. I, "Pratt & Whitney Thermal Barrier Coatings", Bornstein et al., p. 182–193, Oct., 1995.

"Proceedings of the Advanced Turbine Systems Annual Program Review Meeting", vol. I, "Westinhouse Thermal Barrier Coatings", Goedjen et al., p. 194–199, Oct., 1995.

"Proceedings of the Advanced Turbine Systems Annual Program Review Meeting", vol. I, "High Performance Steam Development", Duffy et al., p. 200–220, Oct., 1995.

"Proceedings of the Advanced Turbine Systems Annual Program Review Meeting", vol. II, "Lean Premixed Combustion Stabilized by Radiation Feedback and heterogeneous Catalysis", Dibble et al., p. 221–232, Oct., 1995.

"Proceedings of the Advanced Turbine Systems Annual Program Review Meeting", vol. II, Rayleigh/Raman/LIF Measurements in a Turbulent Lean Premixed Combustor, Nandula et al. p. 233–248, Oct., 1995.

"Proceedings of the Advanced Turbine Systems Annual Program Review Meeting", vol. II, "Lean Premixed Flames for Low $No_x$ Combustors", Sojka et al., p. 249–275, Oct., 1995.

"Proceedings of the Advanced Turbine Systems Annual Program Review Meeting", vol. II, "Functionally Gradient Materials for Thermal Barrier Coatings in Advanced Gas Turbine Systems", Banovic et al., p. 276–280, Oct., 1995.

"Proceedings of the Advanced Turbine Systems Annual Program Review Meeting", vol. II, "Advanced Turbine Cooling, Heat Transfer, and Aerodynamic Studies", Han et al., p. 281–309, Oct., 1995.

"Proceedings of the Advanced Turbine Systems Annual Program Review Meeting", vol. II, "Life Prediction of Advanced Materials for Gas Turbine Application", Zamrik et al., p. 310–327, Oct., 1995.

"Proceedings of the Advanced Turbine Systems Annual Program Review Meeting", vol. II, "Advanced Combustion Technologies for Gas Turbine Power Plants", Vandsburger et al., p. 328–352, Oct., 1995.

"Proceedings of the Advanced Turbine Systems Annual Program Review Meeting", vol. II, "Combustion Modeling in Advanced Gas Turbine Systems", Smoot et al., p. 353–370, Oct., 1995.

"Proceedings of the Advanced Turbine Systems Annual Program Review Meeting", vol. II, "Heat Transfer in a Two–Pass Internally Ribbed Turbine Blade Coolant Channel with Cylindrical Vortex Generators", Hibbs et al. p. 371–390, Oct., 1995.

"Proceedings of the Advanced Turbine Systems Annual Program Review Meeting", vol. II, "Rotational Effects on Turbine Blade Cooling", Govatzidakia et al., p. 391–392, Oct., 1995.

"Proceedings of the Advanced Turbine Systems Annual Program Review Meeting", vol. II, "Manifold Methods for Methane Combustion", Yang et al., p. 393–409, Oct., 1995.

"Proceedings of the Advanced Turbine Systems Annual Program Review Meeting", vol. II, "Advanced Multistage Turbine Blade Aerodynamics, Performance, Cooling, and Heat Transfer", Fleeter et al., p. 410–414, Oct., 1995.

"Proceedings of the Advanced Turbine Systems Annual Program Review Meeting, vol. II", The Role of Reactant Unmixedness, Strain Rate, and Length Scale on Premixed Combustor Performance, Samuelsen et al., p. 415–422, Oct., 1995.

"Proceedings of the Advanced Turbine Systems Annual Program Review Meeting", vol. II, "Experimental and Computational Studies of Film Cooling With Compound Angle Injection", Goldstein et al., p. 423–451, Oct., 1995.

"Proceedings of the Advanced Turbine Systems Annual Program Review Meeting", vol. II, "Compatibility of Gas Turbine Materials with Steam Cooling", Desai et al., p. 452–464, Oct., 1995.

"Proceedings of the Advanced Turbine Systems Annual Program Review Meeting", vol. II, "Use of a Laser–Induced Fluorescence Thermal Imaging System for Film Cooling Heat Transfer Measurement", M. K. Chyu, p. 465–473, Oct., 1995.

"Proceedings of the Advanced Turbine Systems Annual Program Review Meeting", vol. II, Effects of Geometry on Slot–Jet Film Cooling Performance, Hyams et al., p. 474–496 Oct., 1995.

"Proceedings of the Advanced Turbine Systems Annual Program Review Meeting", vol. II, "Steam as Turbine Blade Coolant: Experimental Data Generation", Wilmsen et al., p. 497–505, Oct., 1995.

"Proceedings of the Advanced Turbine Systems Annual Program Review Meeting", vol. II, "Combustion Chemical Vapor Deposited Coatings for Thermal Barrier Coating Systems", Hampikian et al., p. 506–515, Oct., 1995.

"Proceedings of the Advanced Turbine Systems Annual Program Review Meeting", vol. II, "Premixed Burner Experiments: Geometry, Mixing, and Flame Structure Issues", Gupta et al., p. 516–528, Oct., 1995.

"Proceedings of the Advanced Turbine Systems Annual Program Review Meeting", vol. II, "Intercooler Flow Path for Gas Turbines: CFD Design and Experiments", Agrawal et al., p. 529–538, Oct., 1995.

"Proceedings of the Advanced Turbine Systems Annual Program Review Meeting", vol. II, "Bond Strength and Stress Measurements in Thermal Barrier Coatings", Gell et al., p. 539–549, Oct., 1995.

"Proceedings of the Advanced Turbine Systems Annual Program Review Meeting", vol. II, "Active Control of Combustion Instabilities in Low $NO_x$ Gas Turbines", Zinn et al., p. 550–551, Oct., 1995.

"Proceedings ot the Advanced Turbine Systems Annual Program Review Meeting", vol. II, "Combustion Instability Modeling and Analysis", Santoro et al., p. 552–559, Oct., 1995.

"Proceedings of the Advanced Turbine Systems Annual Program Review Meeting", vol. II, "Flow and Heat Transfer in Gas Turbine Disk Cavities Subject to Nonuniform External Pressure Field", Roy et al., p. 560–565, Oct., 1995.

"Proceedings of the Advanced Turbine Systems Annual Program Review Meeting", vol. II, "Heat Pipe Turbine Vane Cooling", Langston et al., p. 566–572, Oct., 1995.

"Proceedings of the Advanced Turbine Systems Annual Program Review Meeting", vol. II, "Improved Modeling Techniques for Turbomachinery Flow Fields", Lakshminarayana et al., p. 573–581, Oct., 1995.

"Proceedings of the Advanced Turbine Systems Annual Program Review Meeting", vol. II, "Advanced 3D Inverse Method for Designing Turbomachine Blades", T. Dang, p. 582, Oct., 1995.

"Proceedings of the Advanced Turbine Systems Annual Program Review Meeting", "ATS and the Industries of the Future", Denise Swink, p. 1, Nov., 1996.

"Proceedings of the Advanced Turbine Systems Annual Program Reveiw Meeting", "Gas Turbine Association Agenda", William H. Day, p. 3–16, Nov., 1996.

"Proceedings of the Advanced Turbine Systems Annual Program Review Meeting", "Power Needs in the Chemical Industry", Keith Davidson, p. 17–26, Nov., 1996.

"Proceedings of the Advanced Turbine Systems Annual Program Review Meeting", "Advanced Turbine Systems Program Overview", David Esbeck, p. 27–34, Nov., 1996.

"Proceedings of the Advanced Turbine Systems Annual Program Review Meeting", "Westinghouse's Advanced Turbine Systems Program", Gerard McQuiggan, p. 35–48, Nov., 1996.

"Proceedings of the Advanced Turbine Systems Annual Program Review Meeting", "Overview of GE's H Gas Turbine Combined Cycle", Cook et al., p. 49–72, Nov., 1996.

"Proceedings of the Advanced Turbine Systems Annual Program Review Meeting", "Allison Advanced Simple Cycle Gas Turbine System", William D. Weisbrod, p. 73–94, Nov., 1996.

"Proceedings of the Advanced Turbine Systems Annual Program Review Meeting", "The AGTSR Industry–University Consortium", Lawrence P. Golan, p. 95–110, Nov., 1996.

"Proceedings of the Advanced Turbine Systems Annual Program Review Meeting", "$NO_x$ and CO Emissions Models for Gas–Fired Lean–Premixed Combustion Turbines", A. Mellor, p. 111–122, Nov., 1996.

"Proceedings of the Advanced Turbine Systems Annual Program Review Meeting", "Methodologies for Active Mixing and Combustion Control", Uri Vandsburger, p. 123–156, Nov., 1996.

"Proceedings of the Advanced Turbine Systems Annual Program Review Meeting", "Combustion Modeling in Advanced Gas Turbine Systems", Paul O. Hedman, p. 157–180, Nov., 19967.

"Proceedings of the Advanced Turbine Systems Annual Program Review Meeting", "Manifold Methods for Methane Combustion", Stephen B. Pope, p. 181–188, Nov., 1996.

"Proceedings of the Advanced Turbine Systems Annual Program Reveiw Meeting", "The Role of Reactant Unmixedness, Strain Rate, and Length Scale on Premixed Combustor Performance", Scott Samuelsen, p. 189–210, Nov., 1996.

"Proceedings of the Advanced Turbine Systems Annual Program Reveiw Meeting", "Effect of Swirl and Momentum Distribution on Temperature Distribution in Premixed Flames", Ashwani K. Gupta, p. 211–232, Nov., 1996.

"Proceedings of the Advanced Turbine Systems Annual Program Review Meeting", "Combustion Instability Studies Application to Land–Based Gas Turbine Combustors", Robert J. Santoro, p. 233–252.

"Proceedings of the Advanced Turbine Systems Annual Program Review Meeting", Active Control of Combustion Instabilities in Low $NO_x$ Turbines, Ben T. Zinn, p. 253–264, Nov., 1996.

"Proceedings of the Advanced Turbine Systems Annual Program Review Meeting", "Life Prediction of Advanced Materials for Gas Turbine Application," Sam Y. Zamrik, p. 265–274, Nov., 1996.

"Proceedings of the Advanced Turbine Systems Annual Program Review Meeting", "Combustion Chemical Vapor Deposited Coatings for Thermal Barrier Coating Systems", W. Brent Carter, p. 275–290, Nov., 1996.

"Proceedings of the Advanced Turbine Systems Annual Program Review Meeting", "Compability of Gas Turbine Materials with Steam Cooling", Vimal Desai, p. 291–314, Nov., 1996.

"Proceedings of the Advanced Turbine Systems Annual Program Review Meeting", "Bond Strength and Stress Measurements in Thermal Barrier Coatings", Maurice Gell, p. 315–334, Nov., 1996.

"Proceedings of the Advanced Turbine Systems Annual Program Review Meeting", "Advanced Multistage Turbine Blade Aerodynamics, Performance, Cooling and Heat Transfer", Sanford Fleeter, p. 335–356, Nov., 1996.

"Proceedings of the Advanced Turbine Systems Annual Program Review Meeting", "Flow Characteristics of an Intercooler System for Power Generating Gas Turbines", Ajay K. Agrawal, p. 357–370, Nov., 1996.

"Proceedings of the Advanced Turbine Systems Annual Program Review Meeting", "Improved Modeling Techniques for Turbomachinery Flow Fields", B. Lakshiminarayana, p. 371–392, Nov., 1996.

"Proceedings of the Advanced Turbine Systems Annual Program Review Meeting", "Development of an Advanced 3d & Viscous Aerodynamic Design Method for Turbomachine Components in Utility and Industrial Gas Turbine Applications", Thong Q. Dang, p. 393–406, Nov., 1996.

"Proceedings of the Advanced Turbine Systems Annual Program Review Meeting", "Advanced Turbine Cooling, Heat Transfer, and Aerodynamic Studies", Je–Chin Han, p. 407–426, Nov., 1996.

"Proceedings of the Advanced Turbine Systems Annual Program Review Meeting", "Heat Transfer in a Two–Pass Internally Ribbed Turbine Blade Coolant Channel with Vortex Generators", S. Acharya, p. 427–446.

"Proceedings of the Advanced Turbine Systems Annual Program Review Meeting", "Experimental and Computational Studies of Film Cooling with Compound Angle Injection", R. Goldstein, p. 447–460, Nov., 1996.

"Proceedings of the Advanced Turbine Systems Annual Program Review Meeting", "Study of Endwall Film Cooling with a Gap Leakage Using a Thermographic Phosphor Fluorescence Imaging System", Mingking K. Chyu, p. 461–470, Nov., 1996.

"Proceedings of the Advanced Turbine Systems Annual Program Review Meeting", "Steam as a Turbine Blade Coolant: External Side Heat Transfer", Abraham Engeda, p. 471–482, Nov., 1996.

"Proceedings of the Advanced Turbine Systems Annual Program Review Meeting", "Flow and Heat Transfer in Gas Turbine Disk Cavities Subject to Nonuniform External Pressure Field", Ramendra Roy, p. 483–498, Nov., 1996.

"Proceedings of the Advanced Turbine Systems Annual Program Review Meeting", "Closed–Loop Mist/Steam Cooling for Advanced Turbine Systems", Ting Wang, p. 499–512, Nov., 1996.

"Proceedings of the Advanced Turbine Systems Annual Program Review Meeting", "Heat Pipe Turbine Vane Cooling", Langston et al., p. 513–534, Nov., 1996.

"Proceedings of the Advanced Turbine Systems Annual Program Review Meeting", "EPRI's Combustion Turbine Program: Status and Future Directions", Arthur Cohn, p. 535,–552 Nov., 1996.
"Proceedings of the Advanced Turbine Systems Annual Program Review Meeting", "ATS Materials Support", Michael Karnitz, p. 553–576, Nov., 1996.
"Proceedings of the Advanced Turbine Systems Annual Program Review Meeting", "Land Based Turbine Casting Initiative", Boyd A. Mueller, p. 577–592, Nov., 1996.
"Proceedings of the Advanced Turbine Systems Annual Program Review Meeting", "Turbine Airfoil Manufacturing Technology", Charles S. Kortovich, p. 593–622, Nov., 1996.
"Proceedings of the Advanced Turbine Systems Annual Program Review Meeting", "Hot Corrosion Testing of TBS's", Norman Bornstein, p. 623–631, Nov., 1996.
"Proceedings of the Advanced Turbine Systems Annual Program Review Meeting", "Ceramic Stationary Gas Turbine", Mark van Roode, p. 633–658, Nov., 1996.
"Proceedings of the Advanced Turbine Systems Annual Program Review Meeting", "Western European Status of Ceramics for Gas Turbines", Tibor Bornemisza, p. 659–670, Nov., 1996.
"Proceedings of the Advanced Turbine Systems Annual Program Review Meeting", "Status of Ceramic Gas Turbines in Russia", Mark van Roode, p. 671, Nov., 1996.
"Status Report: The U.S. Department of Energy's Advanced Turbine systems Program", facsimile dated Nov., 7, 1996.
"Testing Program Results Validate GE's H Gas Turbine—High Efficiency, Low Cost of Electricity and Low Emissions", Roger Schonewald and Patrick Marolda, (no date available).
"Testing Program Results Validate GE's H Gas Turbine—High Efficiency, Low Cost of Electricity and Low Emissions", Slide Presentation—working draft, (no date available).
"The Next Step In H . . . For Low Cost Per kW–Hour Power Generation", LP–1 PGE '98.
"Utility Advanced Turbine System (ATS) Technology Readiness Testing and Pre–Commercialization Demonstration", Document #486040, Oct. 1—Dec. 31, 1996, Publication Date, Jun. 1, 1997, Report Nos.: DOE/MC/31176—5628.
"Utility Advanced Turbine System (ATS) Technology Readiness Testing—Phase 3", Document #666274, Oct. 1, 1996–Sep. 30, 1997, Publication Date, Dec. 31, 1997, Report Nos.: DOE/MC/31176–10.
"Utility Advanced Turbine System (ATS) Technology Readiness Testing and Pre–Commercial Demonstration, Phase 3", Document #486029, Oct. 1—Dec. 31, 1995, Publication Date, May 1, 1997, Report Nos.: DOE/MC/31176–5340.
"Utility Advanced Turbine System (ATS) Technology Readiness Testing and Pre–Commercial Demonstration—Phase 3", Document #486132, Apr. 1—Jun. 30, 1976, Publication Date, Dec. 31, 1996, Report Nos.: DOE/MC/31176–5660.
"Utility Advanced Turbine System (ATS) Technology Readiness Testing and Pre–Commercial Demonstration—Phase 3", Document #587906, Jul. 1—Sep. 30, 1995, Publication Date, Dec. 31, 1995, Report Nos.: DOE/MC/31176–5339.
"Utility Advanced Turbine System (ATS) Technology Readiness Testing and Pre–Commercial Demonstration" Document #666277, Apr. 1—Jun. 30, 1997, Publication Date, Dec. 31, 1997, Report Nos.: DOE/MC/31176–8.
"Utility Advanced Turbine System (ATS) Technology Readiness Testing and Pre–Commercialization Demonstration" Jan. 1—Mar. 31, 1996, DOE/MC/31176—5338.
"Utility Advanced Turbine System (ATS) Technology Readiness Testing: Phase 3R", Document #756552, Apr. 1—Jun. 30, 1999, Publication Date, Sep. 1, 1999, Report Nos: DE—FC21–95MC31176–23.
"Utility Advanced Turbine System (ATS) Technology Readiness Testing.", Document #656823, Jan. 1—Mar. 31, 1998, Publication Date, Aug. 1, 1998, Report Nos.: DOE/MC/31176–17.
"Utility Advanced Turbine Systems (ATS) Technology Readiness Testing and Pre–Commercial Demonstration", Annual Technical Progress Report, Reporting Period: Jul. 1, 1995—Sep. 30, 1996.
"Utility Advanced Turbine Systems (ATS) Technology Readiness Testing", Phase 3R, Annual Technical Progress Report, Reporting Period: Oct. 1, 1997—Sep. 30, 1998.
"Utility Advanced Turbine Systems (ATS) Technology Readiness Testing", Document #750405, Oct. 1—Dec. 30, 1998, Publication Date: May, 1, 1999, Report Nos.: DE–FC21–95MC31176–20.
"Utility Advanced Turbine Systems (ATS) Technology Readiness Testing", Document #1348, Apr. 1—Jun. 29, 1998, Publication Date Oct. 29, 1998, Report Nos. DE–FC21–95MC31176—18.
"Utility Advanced Turbine Systems (ATS) Technology Readiness Testing—Phase 3", Annual Technical Progress Report, Reporting Period: Oct. 1, 1996—Sep. 30, 1997.
"Utility Advanced Turbine Systems (ATS) Technology Readiness Testing and Pre–Commercial Demonstration", Quarterly Report, Jan. 1—Mar. 31, 1997, Document #666275, Report Nos.: DOE/MC/31176–07.
"Proceedings of the 1997 Advanced Turbine Systems", Annual Program Review Meeting, Oct. 28–29, 1997.

* cited by examiner

RETENTION SYSTEM AND METHOD FOR THE BLADES OF A ROTARY MACHINE

This is a continuation of application Ser. No. 09/466,900, filed Dec. 20, 1999, now abandoned, the entire content of which is hereby incorporated by reference in this application.

This invention was made with Government support under Contract No. DE-FC21-95MC-31176 awarded by the Department of Energy. The Government has certain rights in this invention.

BACKGROUND OF THE INVENTION

This invention relates to turbo machinery rotor construction and, more particularly, to structure for axially retaining the rotor blades on the rotor disk of a turbo machine.

Turbo machinery such as high performance gas turbine engines have a compressor and turbine that each includes one or more annular banks or rows of axially spaced fixed stator vanes that are positioned between rows of rotatable rotor blades. Each rotor blade is formed with a rotor tip, an airfoil and a dovetail-shaped base or root that mounts within a mating, generally axial slot formed between adjacent dovetail posts on the web of the rotor disk.

In order to prevent axial movement of the rotor blades, i.e., along the longitudinal axis of the rotor disk and engine, one or more blade retainers are mounted adjacent the axial slots in the rotor disk. Conventional retention systems, however, have inadequate retention capabilities for gas turbines with large axial aerodynamic loads on the blades caused by, for example, compressor stalls, blade rubs, ingestion of objects, and the like.

BRIEF SUMMARY OF THE INVENTION

In an exemplary embodiment of the invention, a blade retention system is provided for a rotating machine having a hub with a plurality of shaped, generally axially extending openings at circumferentially spaced positions about the hub. A plurality of blades having complementary-shaped base portions are received in the openings, and each of the blades is provided with a blade retention slot therein. A circumferential hub slot is formed about a circumference of the hub, wherein the blade retention slots are substantially aligned with the circumferential hub slot when the blades are received in the openings. At least one ring segment is secured in the blade retention slots and the circumferential hub slot. The circumferential hub slot is preferably substantially U-shaped such that an open end of the circumferential hub slot faces a center of the hub, and the blade retention slots are similarly substantially U-shaped such that open ends thereof face the center of the hub. The ring segments preferably extend between 20° and 360° and preferably 24° in one embodiment and 180° in another embodiment.

A key may be provided for securing the ring segment in the blade retention slots and the circumferential hub slot. The key includes a hook portion at one end of the key engageable with the ring segment and a threaded portion at an opposite end of the key. In this context, the blade retention system further includes a nut that is cooperatively engageable with the threaded portion of the key. The key is preferably disposed in a hole in the hub that includes a key receiving portion of a first diameter that receives the key and a nut receiving portion of a second diameter, larger than the first diameter to thereby define a shoulder, that receives the nut. The nut is structurally supported by the shoulder to pull the key into locking engagement with the ring segment. An inside diameter of the nut receiving portion may be threaded, and the blade retention system may further include a cap threaded into engagement with the hole in the hub. In an alternative arrangement, the key is disposed in a hole in at least one of the complementary-shaped base portions of the blades.

In another exemplary embodiment of the invention, a blade retention system is provided for a rotating machine including a turbo machinery blade with a dovetail portion shaped to fit into a complementary-shaped opening in a hub for rotation about a hub axis. The blade retention system includes a securing slot defined by (1) a blade retention slot in the turbo machinery blade and (2) a circumferential hub slot formed about a circumference of the hub and substantially aligned with the blade retention slot when the dovetail portion is fit into the complementary-shaped opening in the hub. The blade retention system also includes at least one ring segment engageable with the securing slot to thereby retain the blade from axial displacement.

In yet another exemplary embodiment of the invention, a method of retaining blades in a rotating machine includes the steps of (a) machining a blade slot in each of the plurality of blades, (b) machining a circumferential hub slot about a circumference of the hub such that the blade retention slots are substantially aligned with the circumferential hub slot when the blades are received in the openings, (c) positioning the blades in the openings, and (d) securing at least one ring segment in the blade retention slots and the circumferential hub slot. Step (d) may be practiced by inserting at least one key having a key opening adjacent the blade retention slots and the circumferential hub slot, fitting the at least one ring segment into the key opening, and urging the key toward the blade retention slots and the circumferential hub slot. Step (d) may further be practiced by forming a hole in one of the hub or base portions of the blades, and inserting the key into the hole prior to fitting the ring segment into the key opening. Step (d) may be still further practiced by forming threads at an inside diameter of the hole and threading the cap to the hole.

DETAILED DESCRIPTION OF THE INVENTION

Figure 1:
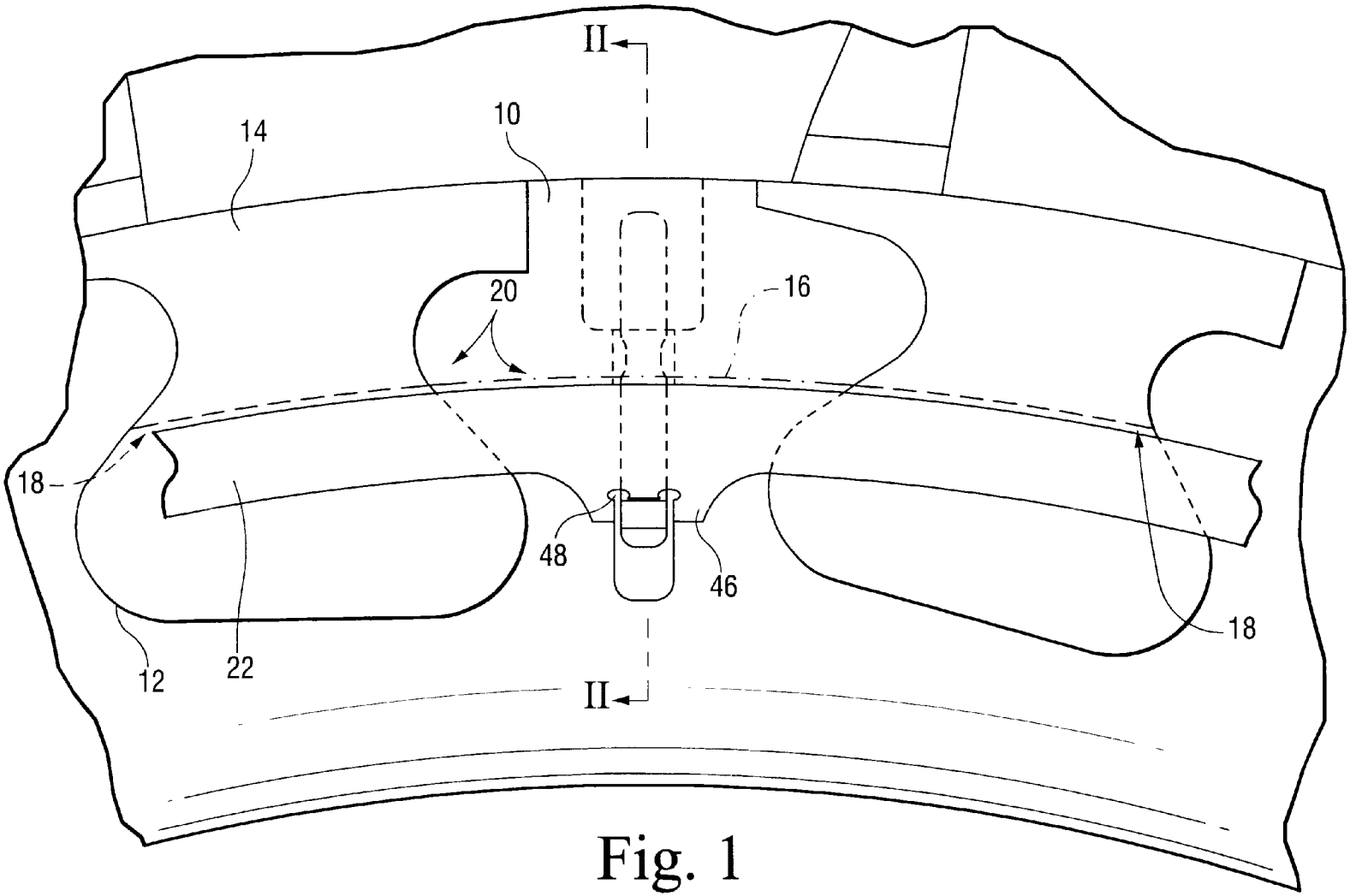
FIG. 1 is an axial view of the retention system of the invention.
Figure 2:
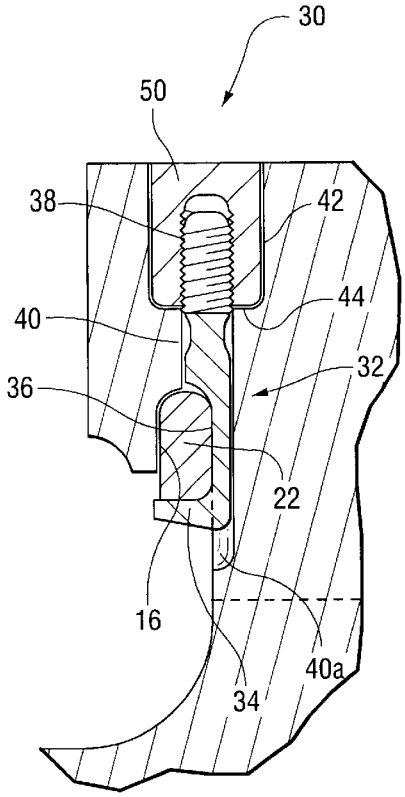
FIG. 2 is a cross sectional view along line II—II in FIG. 1.

With reference to FIGS. 1 and 2, a hub 10 of a rotor or other rotary machine is provided with dovetail or like-shaped openings 12 for receiving a dovetail or base portion 14 of a turbo machinery blade. The dovetail 14 and complementary-shaped opening 12 in the hub 10 serve to retain the turbo machinery blades radially. As noted, since the dovetails are oriented in an axial direction, a retention system such as the retention system of the present invention is required to prevent axial movement of the blades.

Typically, the dovetail axis forms an angle with the engine centerline that ranges from 0° to about 50°, and the retention system of the invention is useful for the entire range of dovetail angles.

The blade retention system of the invention includes a circumferential groove or slot 16 machined or otherwise formed about a circumference of the hub in the forward or aft face of the rotor structure for the stage where axial retention is desired. The circumferential hub slot 16 is preferably U-shaped such that an open end thereof faces a center of the hub 10 as shown. A correspondingly U-shaped blade retention slot 18 is machined or otherwise formed in the dovetail portions 14 of the turbo machinery blades. The blade retention slots 18 are similarly oriented such that open ends thereof face the center of the hub 10. When the dovetail portions 14 of the turbo machinery blades are fit into the complementary-shaped openings 12 in the hub 10, the blade retention slots 18 are substantially aligned with the circumferential hub slot 16 to define a securing slot 20 that spans the circumference of the hub 10.

In order to axially retain the blades, at least one ring segment 22 is secured in the aligned blade retention slots 18 and circumferential hub slot 16, i.e., the securing slot 20. Preferably, each ring segment 22 spans between 20° and 360° of the hub circumference. Of course, each blade must be retained from axial movement such that, for example, with a rotor incorporating fifteen blades evenly spaced about the circumference thereof, a minimum of fifteen ring segments 22 would be required, each spanning about 24°. A typical rotor stage could include up to 100 blades. In a preferred arrangement, however, the retention system is provided with two ring segments 22, each extending 180°.

In order to tighten and secure the ring segments 22 in the securing slot 20, a key assembly 30 is provided for at least each of the ring segments 22. (With longer ring segments, more than one key assembly may be desirable.) The key assembly 30 includes a key 32 having a hook portion 34 at one end of the key, a key opening 36 at an intermediate portion of the key, and a threaded portion 38 at an opposite end of the key. A hole is drilled in the hub with a drill or the like of a first diameter to define a key receiving portion 40. Subsequently, using a drill of a second diameter, larger than the first diameter, a nut receiving portion 42 of the hole is formed. Because the nut receiving portion 42 has a larger diameter than the key receiving portion 40, a shoulder 44 is defined in the hole.

In order to secure the ring segments 22 in the securing slot 20, after machining the circumferential hub slot 16 and the blade retention slots 18 and after drilling the key receiving portion 40 and nut receiving portion 42, the key 32 is inserted into the hole as far as possible into an extended key receiving area 40*a*. The ring segments 22 are then placed over the hook portion 34 into the key opening 36 of the key 32, partially within the securing slot 20. To facilitate placement of the ring segments 22, each ring segment or at least each portion of the ring segments configured for receiving a key assembly 30, is provided with a tab area 46 including a slot 48 to facilitate seating of the ring segments 22.

With this configuration, a nut 50 having internal threads is inserted into the nut receiving portion 42 of the hole over the threaded portion 38 of the key 32. As the nut 50 is rotated, once supported by the shoulder 44, the key 32 is driven radially outward (upward in FIG. 2) via the action of the threads, and the ring segments 22 are brought into secure engagement within the securing slot 20.

The ring segments 22 are preferably formed of a strong material such as steel or nickel-steel, depending on the operating temperature of the machine. The key 32 carries considerably less load than the ring segments 22, and a preferred material for the key 32 is titanium. Of course, those of ordinary skill in the art will contemplate other materials that may be suitable for a particular application, and the invention is not meant to be limited to a specific material.

Figure 4:
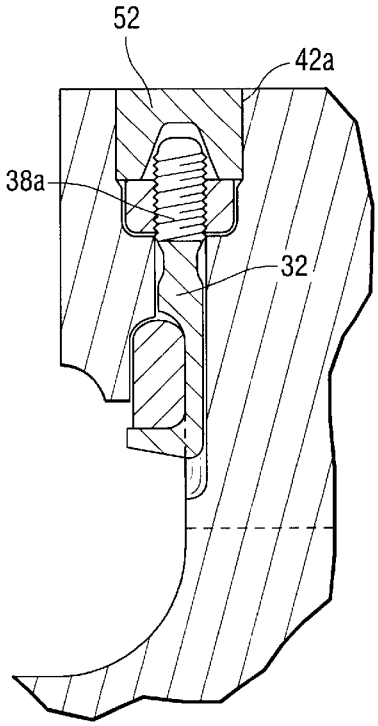
FIG. 4 is a cross sectional view along line IV—IV in FIG. 3.
Figure 3:
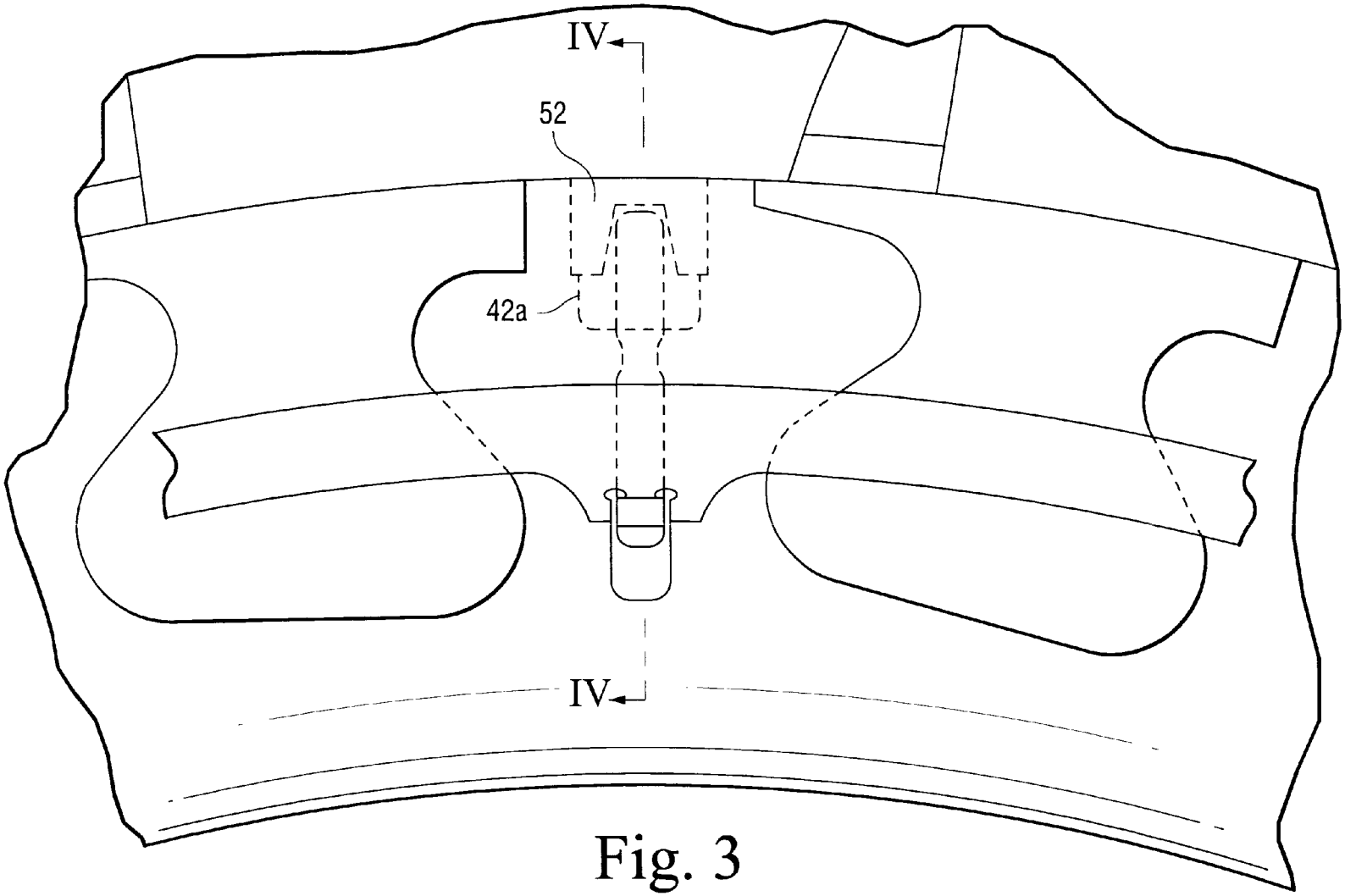
FIG. 3 is an axial view of an alternative embodiment retention system of the invention.

FIGS. 3 and 4 illustrate an alternative embodiment of the present invention. In this embodiment, the threaded portion 38*a* of the key 32 is slightly shorter than the threaded portion 38 in the first embodiment. Additionally, the nut receiving hole 42*a* is modified to incorporate internal threads. In this embodiment, in order to provide a redundant back-up load path for centrifugal loads on the key 32, a cap 52 is threaded into the nut receiving hole 42*a*. Otherwise, the function configuration of the arrangement in this embodiment is the same as that of the first embodiment, and further description thereof will be omitted.

Figure 5:
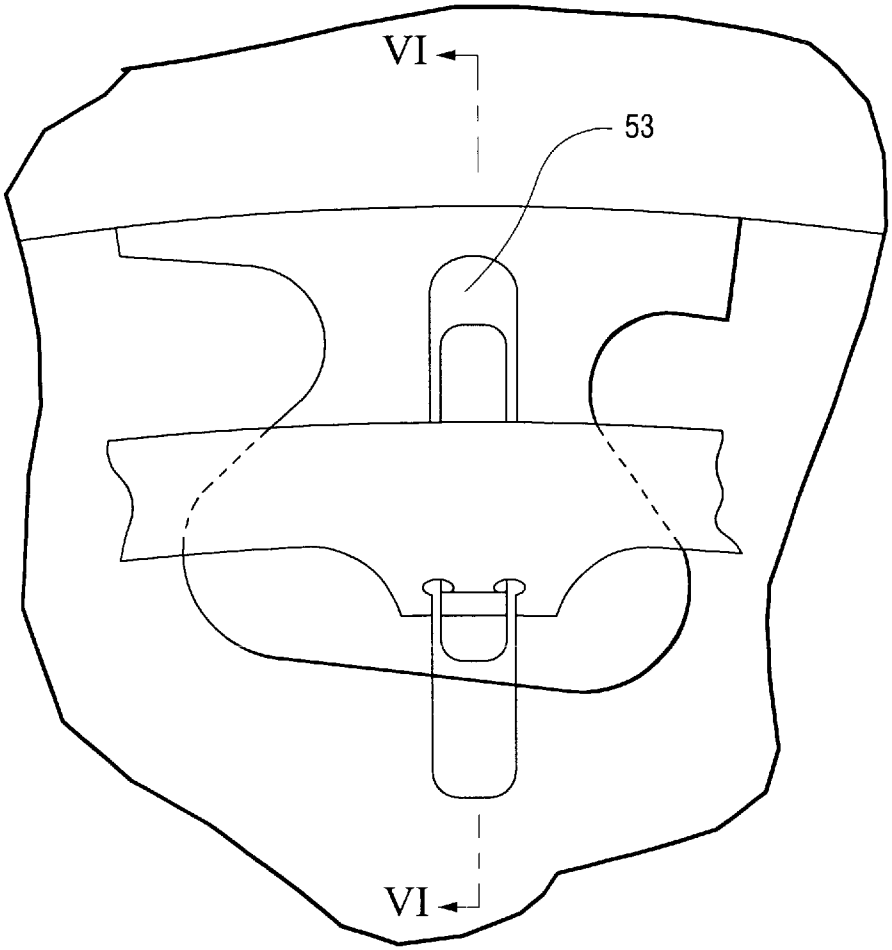
FIG. 5 is an axial view of another alternative embodiment retention system of the invention.
Figure 6:
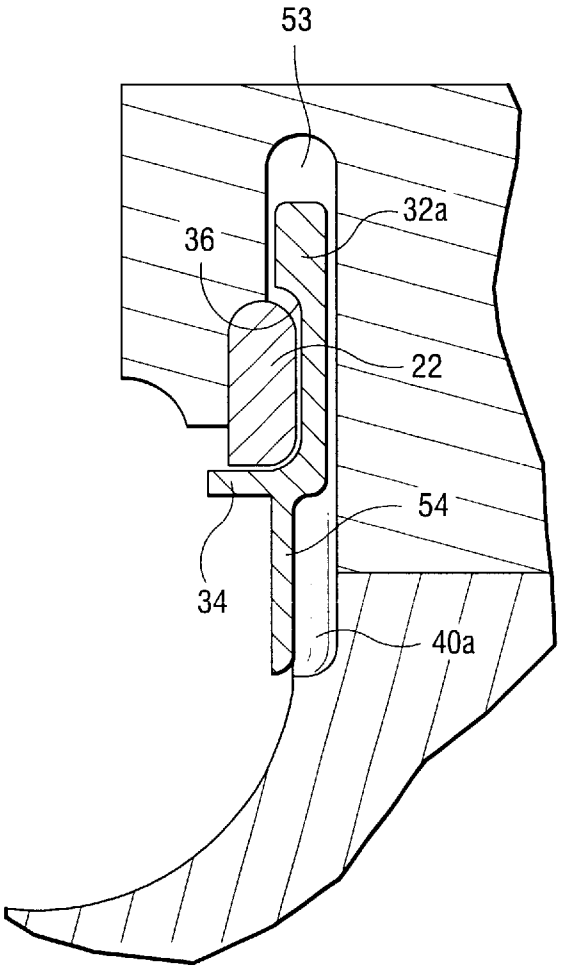
FIG. 6 is a cross sectional view along line VI—VI in FIG. 5.

In still another alternative embodiment, referring to FIGS. 5 and 6, the hole previously formed in the rotor structure for the key assembly is rather formed in the dovetail sections 14 of the blades. In this embodiment, a modified key 32*a* is provided without the threaded portion 38 but includes the key opening 36 and hook portion 34. A key extension 54 is provided at a radially inward end of the key 32*a* to secure the key 32*a* in the hole 53. That is, during assembly, after inserting the ring segments 22 into the key opening 36 of the key 32*a*, the key 32*a* is manually driven radially outward or using a tool designed for this purpose, and the key extension 54 is bent into the hole extension 40*a* to secure the key and ring segments. This configuration provides an integrated back-up load path for the key.

With the construction of the present invention, retainer sections with high axial load capacity can be installed and removed easily. Each retainer segment and its key assembly can be configured to provide retention for one-half or fewer of the blades in a stage. As such, a retainer section can be removed and reinstalled without requiring access to the entire circumference of the stage. Moreover, the system requires no machining between stages in the axial direction, and installation and removal does not require pin insertion, staking or bolting between stages in the axial direction.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A blade retention system for a rotating machine comprising:

a hub having a plurality of shaped, generally axially extending openings at circumferentially spaced positions about the hub;

a plurality of blades having complementary-shaped base portions received in the openings, each of the blades having a blade retention slot therein;

a circumferential hub slot formed about a circumference of the hub, wherein the blade retention slots are substantially aligned with the circumferential hub slot when the blades are received in the openings;

at least one ring segment secured in the blade retention slots and the circumferential hub slot; and a key securing the at least one ring segment in the blade retention slots and the circumferential hub slot, the key including a hook portion at one end thereof engageable with the at least one ring segment, the hook portion being displaced radially outwardly to secure the ring segment.

2. A blade retention system according to claim 1, wherein the circumferential hub slot is substantially U-shaped such that an open end of the circumferential hub slot faces a center of the hub, and wherein the blade retention slots are substantially U-shaped such that open ends thereof face the center of the hub.

3. A blade retention system according to claim 1, wherein the at least one ring segment extends 20–360°.

4. A blade retention system according to claim 3, wherein the at least one ring segment extends 24°.

5. A blade retention system according to claim 3, wherein the at least one ring segment extends 180°.

6. A blade retention system according to claim 1, wherein the key further comprises a threaded portion at an opposite end of the key, wherein the blade retention system further comprises a nut that is cooperatively engageable with the threaded portion of the key.

7. A blade retention system according to claim 6, wherein the key is disposed in a hole in the hub comprising a key receiving portion of a first diameter that receives the key and a nut receiving portion of a second diameter, larger than the first diameter to thereby define a shoulder, that receives the nut, the nut being supported by the shoulder to pull the key into locking engagement with the at least one ring segment.

8. A blade retention system according to claim 7, wherein an inside diameter of the nut receiving portion is threaded, and wherein the blade retention system further comprises a cap threaded into engagement with the hole in the hub.

9. A blade retention system according to claim 6, wherein the key is disposed in a hole in at least one of the complementary-shaped base portions of the blades.

10. A blade retention system for a rotating machine, wherein a turbomachinery blade has a dovetail portion shaped to fit into a complementary-shaped opening in a hub for rotation about a hub axis, the blade retention system comprising:

a securing slot defined by (1) a blade retention slot in the turbomachinery blade and (2) a circumferential hub slot formed about a circumference of the hub and substantially aligned with the blade retention slot when the dovetail portion is fit into the complementary-shaped opening in the hub;

at least one ring segment engageable with the securing slot to thereby retain the blade from axial displacement; and a key securing the at least one ring segment in the securing slot, the key including a hook portion at one end thereof engageable with the at least one ring segment, the hook portion being displaced radially outwardly to secure the ring segment.

11. A blade retention system according to claim 10, wherein the key further comprises a threaded portion at an end of the key opposite the hook portion, and wherein the blade retention system further comprises a nut that is cooperatively engageable with the threaded portion of the key.

12. A blade retention system according to claim 11, wherein the key is disposed in a hole in the hub comprising a key receiving portion of a first diameter that receives the key and a nut receiving portion of a second diameter, larger than the first diameter to thereby define a shoulder, that receives the nut, the nut being supported by the shoulder to pull the key into locking engagement with the at least one ring segment.

13. A blade retention system according to claim 12, wherein an inside diameter of the nut receiving portion is threaded, and wherein the blade retention system further comprises a cap threaded into engagement with the hole in the hub.

14. A blade retention system according to claim 10, wherein the key is disposed in a hole in the dovetail portion of the blade.

15. A method of retaining blades in a rotating machine having a hub and a plurality of shaped, generally axially extending openings at circumferentially spaced positions about the hub, the blades having complementary-shaped base portions received in the openings, the method comprising:

(a) machining a blade slot in each of the plurality of blades;

(b) machining a circumferential hub slot about a circumference of the hub such that the blade retention slots are substantially aligned with the circumferential hub slot when the blades are received in the openings;

(c) positioning the blades in the openings; and (d) securing at least one ring segment in the blade retention slots and the circumferential hub slot by inserting at least one key having a key opening adjacent the blade retention slots and the circumferential hub slot, fitting the at least one ring segment into the key opening, and urging the key toward the blade retention slots and the circumferential hub slot.

16. A method according to claim 15, wherein step (d) is further practiced by forming a hole in one of the hub or base portions of the blades, and inserting the key into the hole prior to fitting the at least one ring segment into the key opening.

17. A method according to claim 16, wherein step (d) is further practiced by forming threads at an inside diameter of the hole and threading a cap into the hole.

* * * * *